United States Patent [19]

Sonntag

[11] 4,189,831

[45] Feb. 26, 1980

[54] INDUSTRIAL SCISSORS

[75] Inventor: Paul A. Sonntag, Doraville, Ga.

[73] Assignee: Western Electric Company, Incorporated, New York, N.Y.

[21] Appl. No.: 954,150

[22] Filed: Oct. 24, 1978

[51] Int. Cl.[2] ..... B26B 13/12

[52] U.S. Cl. ..... 30/232; 30/271

[58] Field of Search ..... 30/232, 254, 261, 257, 30/271

[56] References Cited

U.S. PATENT DOCUMENTS

| | | | |
|---|---|---|---|
| 848,966 | 4/1907 | Carlson | 30/261 |
| 1,231,103 | 6/1917 | Viertels | 30/261 X |
| 1,757,173 | 5/1930 | Dingman | 30/261 X |
| 2,791,833 | 5/1957 | Chudner | 30/232 X |

*Primary Examiner*—Jimmy C. Peters

*Attorney, Agent, or Firm*—Robert B. Kennedy

[57] ABSTRACT

Industrial scissors having one handle formed with a ring through which fingers may be inserted and the other handle formed with an elongated arched bar having a convex surface against which a palm may be snugly seated and pressed.

6 Claims, 6 Drawing Figures

INDUSTRIAL SCISSORS

TECHNICAL FIELD

This invention relates generally to scissors, and particularly to scissors for use in industry.

BACKGROUND OF THE INVENTION

General purpose scissors are normally used only intermittently by members of the public at large. In certain business and industrial environments however scissors are used on virtually a continuous basis. Barbers, for example, will often spend several hours a day holding and operating scissors. Some industrial workers, such are those employed in textile plants and wire mills, also hold and operate scissors over extended periods of time. If such workers grip scissors in the usual manner with the thumb extended through one handle ring and the middle finger extended through the other handle ring, the ability of the worker to perform tasks other than cutting with the scissors held hand is significantly impaired. For example, where their work requires them to grip or position articles intermittently, the scissors tend to restrict such operations. Though one can ordinarily still grip an article with the thumb and index finger extending through the handle rings of scissors, such may create a safety problem. In textile plants and wire mills the user's hands are frequently in close proximity with reels, spindles and the like that are rotating at high speeds. Were the scissors inadvertently to make contact with such machinery with two fingers locked to a common pair of scissors, severe injury could result. Nevertheless, to overcome this handicap and danger by discarding the scissors each time another operation is required, only to retake them upon its completion, creates an obvious inefficiency. Furthermore, use of the other hand is often unavailable as a solution to this problem since it may be otherwise occupied or engaged. In addition, the worker may be insufficiently ambidextrous to perform work well with that other hand.

For these reasons many industrial workers have tended to hold and operate scissors in a manner that is quite different from that used by the general public. Specifically, industrial workers often "palm" the scissors with the index or middle finger extended through one handle ring while the other handle ring is merely pressed between the thumb and palm. This grip provides the thumb and index finger with greater freedom to grip items other than the scissors as needed without having to release the scissors themselves. Furthermore, the hand is rendered less susceptible to injury with this grip should a force be suddenly applied to the scissors since the scissors are free to pivot about one finger or be pitched clear from the hand entirely. In this manner the worker can more readily alternate between cutting and gripping operations.

Unfortunately, the just-described palming method of holding and using scissors in industrial environments has frequently tended to produce some numbness or soreness in the hands of the users. An appreciation of a common cause for this may be readily gained from a brief examination of the anatomy of the human hand as shown in FIG. 4. Here the hand is seen to include a radial artery 10 and median nerve 12 that extend along the juncture of the thumb palmar area with the remaining portion of the palm in region 14 at the base of the thenar eminence muscle. A worker gripping a conventional pair of scissors in the just-described palming manner will therefore exert small area contact pressure against the radial artery and median nerve. This concentrated pressure upon the artery and nerve usually accounts for the soreness and numbness experienced by the workers. Nevertheless, they have typically tended to elect to accept this malady rather than to lose the efficiency which is gained by employing the palming manner of holding and operating scissors.

Accordingly, it is a general object of the present invention to provide improved scissors.

More specifically, it is an object of the invention to provide industrial scissors capable of being gripped for operation in such a manner as to provide increased freedom of movement of the thumb and index finger for gripping purposes.

Another object of the invention is to provide industrial scissors which may be gripped in such a manner as to lessen the danger of injury to the hand in the event an extraneous force is inadvertently applied to the scissors while gripped.

Another object of the invention is to provide industrial scissors which may be held in the palm of the hand and operated without exerting small area contact pressure on the palm.

SUMMARY OF THE INVENTION

In one form of the invention, industrial scissors are provided comprising a first cutting element having a blade from which a first handle extends and a second cutting element having a blade from which a second cutting element extends. The first handle is formed with a ring through which a finger may be inserted. The second handle is formed with an elongated arched bar having a convex surface against which a palm may be snugly seated and pressed and generally concave surface opposite said convex surface from which a stop protrudes against a side of which a thumb may be pressed. The first and second elements are pivoted together with the first handle ring located adjacent the second handle concave surface and stop.

In another form of the invention industrial scissors are provided comprising a first cutting element having a first blade from which a first handle extends, and a second cutting element having a second blade with a planar side from which a second handle extends. The first handle is formed with a ring through which a finger may extend while the second handle is formed with an elongated handlebar having a flat convexly arched rim canted with respect to a plane oriented normal to the second blade planar side against which rim a palm may be snugly seated and pressed. The first and second cutting elements are pivoted with the first blade in sliding contact with the second blade planar side and with the second handle handlebar rim facing away from the first handle ring.

DESCRIPTION OF THE PREFERRED EMBODIMENTS

Figure 4:
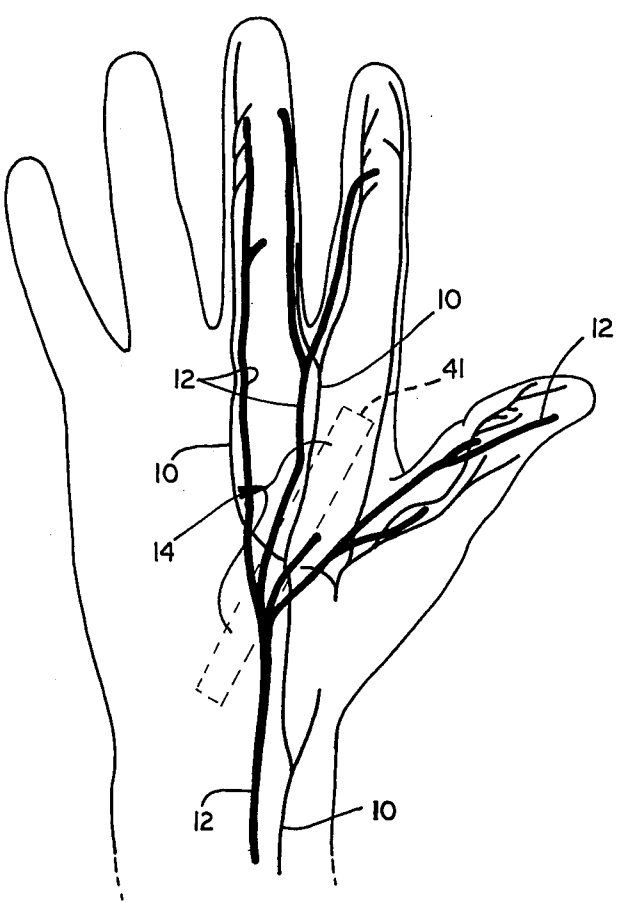
FIG. 4 is an outline drawing of a human right hand with the location of selected nerves and arteries shown.
Figure 2:
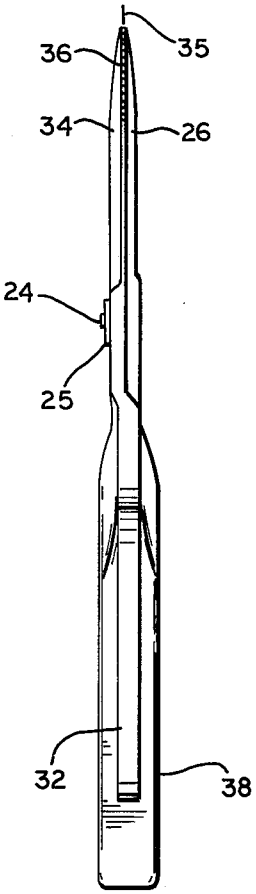
FIG. 2 is the bottom plan view of the industrial scissors shown in FIG. 1.

Referring now in more detail to the drawing, there is shown industrial scissors which comprise a first cutting element 20 pivotably mounted to a second cutting element 22 by means of a screw 24 and nut 25. The first cutting element 20 is seen to be of conventional structure having a blade 26 formed with a sharp cutting edge 28 from which a handle 30 extends that defines a ring 32. The other cutting element 22 however is seen to have a blade 34 formed with a serrated cutting edge 36 from which an arched, bar-shaped handle or handlebar 38 extends. This bar shaped handle is seen to have a convexly arched surface or rim 40 which is canted at an angle AA with respect to a plane 42 that extends normally to the cutting plane 35 of the blade 34. Preferably, the angle AA is approximately 20 degrees while the rim has substantial width on the order of some three-eights of an inch.

Figure 1:
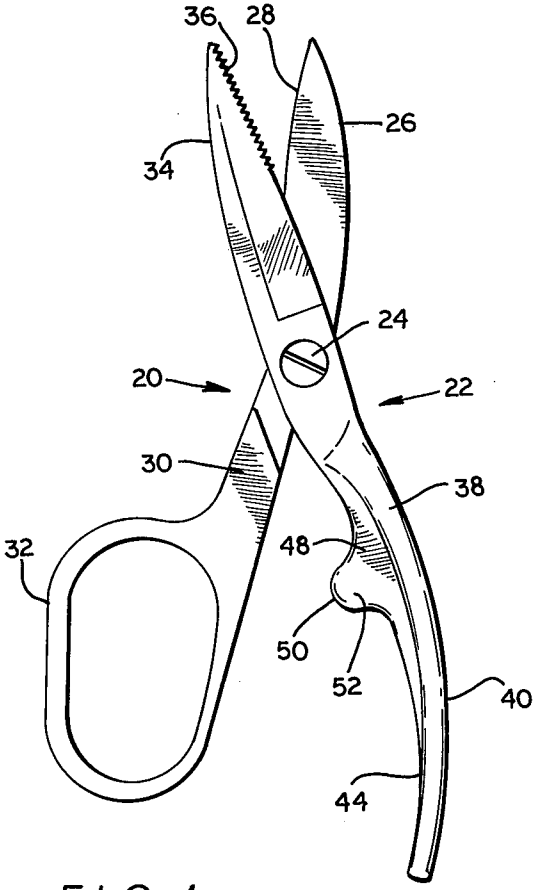
FIG. 1 is a side elevational view of industrial scissors embodying principles of the present invention in one preferred form.

The handle 38 is also seen to have a generally concave surface 44 facing ring 32 located opposite that of the canted, convex surface or rim 40. One side of the elongated bar-shaped handle that connects the opposed surfaces 40 and 44 is seen to be provided with a concave surface portion 48 that merges with a flat side surface 52 of a stop 50. With this shape of the side the scissors are adapted for right hand usage. Adaptations for use with the left hand have the convex surface 48 on the opposite side from that shown in FIG. 1 of the elongated bar-shaped handle with the cant of the rim 40 also reversed.

Figure 6:
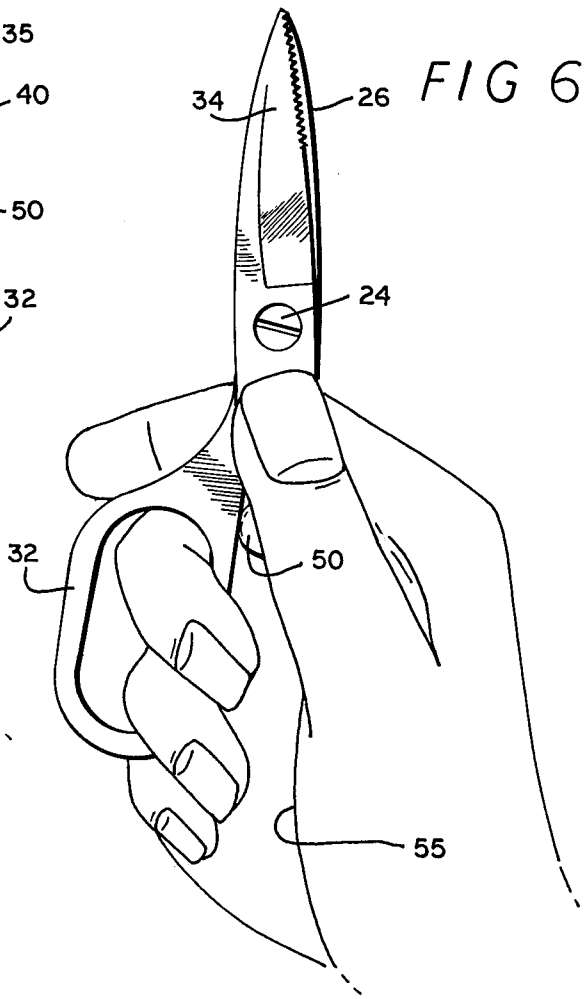
FIG. 6 is a pictorial illustration of the scissors shown in FIG. 1 manually gripped with the scissors blades in a closed position.
Figure 3:
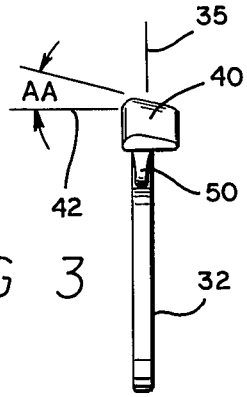
FIG. 3 is a rear-end view in elevation of the scissors shown in FIG. 1.
Figure 5:
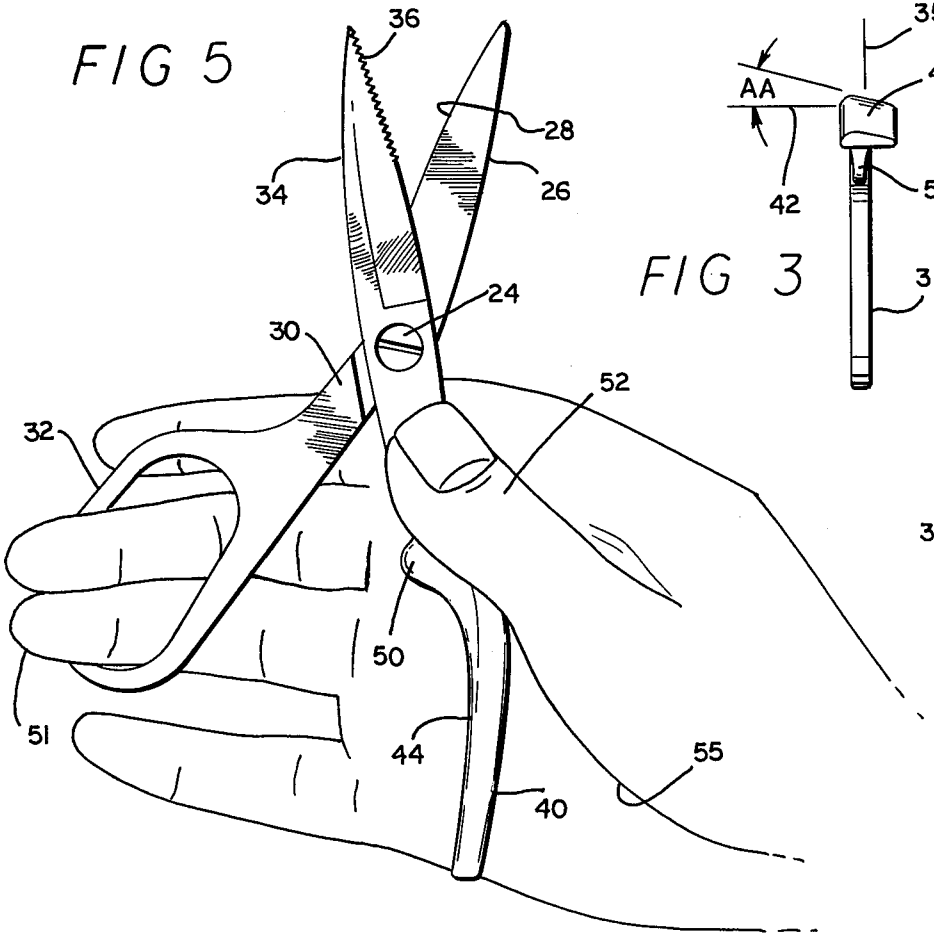
FIG. 5 is a pictorial illustration of the scissors shown in FIG. 1 manually gripped with the scissors blades in an open position as for cutting.

With reference next to FIGS. 5 and 6 the manner in which the just-described industrial scissors may be used is illustrated. Here it is seen that the scissors are manually gripped by extending the middle finger and ring finger 51 through handle ring 32 and by pressing the thumb 52 against the concave surface portion 48 and stop side 52 of the handle 38. This grip places the canted rim 40 over a relatively large area 41 of the palm as shown in FIG. 4. By moving the fingers inserted through ring 32 jointly towards the thumb palmar area 55 the blades 26 and 34 are brought to the closed position of FIG. 6 to effect a cutting operation. By conversely moving the fingers jointly away from the thumb palmar area while continuing to press the thumb 52 against the side of the handle as above described the scissors blades are reopened. When the scissors are not in use the thumb may be released from the handle 38 with the scissors loosely cradled in the palm with the fingers extending through the sole ring 32 thereby freeing the hand for other tasks.

It should be understood that the just-described embodiment merely illustrates principles of the invention in one preferred form. Many modifications, additions and deletions may, of course, be made thereto without departure from the spirit and scope of the invention as set forth in the following claims.

I claim:

1. Industrial scissors comprising a first cutting element having a blade from which a first handle extends and a second cutting element having a blade from which a second handle extends, and with said first handle formed with a ring through which a finger may be inserted, and with said second handle formed with an elongated arched bar having a convex surface against which a user palm may be snugly seated and pressed and a generally concave surface opposite said convex surface from which a stop unitarily protrudes against a side of which a thumb may be pressed, said first and second cutting elements being pivoted together for unbiased pivotal movement with said first handle ring located adjacent said second handle concave surface and stop.

2. A scissors in accordance with claim 1 wherein said second element handle elongated bar has a side extending between said convex and concave surfaces formed with a concave surface, and wherein said stop has a generally flat side surface that unitarilly merges with said bar side concave surface whereby a thumb may be nestled against the bar concave side surface and stop side.

3. A scissors in accordance with claim 1 or 2 wherein said first and second cutting elements are pivoted together for a movement of said blades along a cutting plane, and wherein said second handle convex surface is canted with respect to said cutting plane.

4. A scissors in accordance with claim 1 wherein said second element handle consists essential of said elongated arched bar and stop.

5. Industrial scissors comprising a first cutting element having a first blade from which a first handle extends and a second cutting element having a second blade formed with a planar side from which a second handle extends, and with said first handle having a ring through which a user finger may extend, and with said second handle unitarily formed with an elongated handlebar having a flat, convexly arched rim canted with respect to a plane normal to the plane of said second blade side against which a user palm may be snugly seated and pressed having a generally concave inner surface opposite said rim from which a protruding stop extends towards said second handle, said first and second cutting elements being pivoted together for unbiased pivotal movement with said first blade in sliding contact with said second blade planar side and with said second handle canted flat rim facing away from said first handle ring.

6. A scissors in accordance with claim 5 wherein said second handle has a side extending between said rim and inner surface with said side having a concave side surface, and wherein said stop has a generally flat side surface that unitarilly merges with said handlebar concave side surface whereby a user thumb may be nestled against the handlebar concave side surface and stop side.

* * * * *